US005941101A

United States Patent [19]

Callo

[11] Patent Number: 5,941,101

[45] Date of Patent: Aug. 24, 1999

[54] BELT EDGE BURNISHING MACHINE

[75] Inventor: Carmen Callo, Lockport, Ill.

[73] Assignee: Humphreys, Inc., Chicago, Ill.

[21] Appl. No.: 08/912,488

[22] Filed: Aug. 18, 1997

[51] Int. Cl.[6] ..... C14B 11/00; B24B 7/00

[52] U.S. Cl. ..... 69/7.7; 69/17; 69/37; 451/188

[58] Field of Search ..... 69/1, 17, 6.5, 7.7, 69/37, 40, 41, 44, 47; 451/182, 184, 188

[56] References Cited

U.S. PATENT DOCUMENTS

| | | | |
|---|---|---|---|
| 1,734,365 | 11/1929 | Collins . | |
| 1,935,827 | 11/1933 | Zwanzig | 69/17 |
| 2,381,807 | 8/1945 | Davis et al. | 69/17 |
| 2,664,732 | 1/1954 | Tuck . | |
| 3,129,447 | 4/1964 | Ralphs . | |
| 3,733,754 | 5/1973 | Jeske . | |
| 4,335,543 | 6/1982 | Pike . | |
| 5,144,737 | 9/1992 | Riesmeir . | |

*Primary Examiner*—Michael A. Neas
*Assistant Examiner*—Gary L. Welch
*Attorney, Agent, or Firm*—Larry L. Saret; Laff, Whitesel & Saret, Ltd.

[57] ABSTRACT

A belt edge burnishing machine for burnishing the edges of a plurality of belts simultaneously. The belt edge burnishing machine comprises a conveyor and at least one buffing wheel positioned above the conveyor which is rotated about an axis parallel to the ground and to the conveyor. The belts are stacked on an edges finish board with the unfinished edges facing up. The edge finish board is placed on the conveyor which conveys the plurality of belts through the burnishing machine. As the belts pass beneath the rotating buffing wheel, the buffing wheel contacts all of the exposed unfinished edges, thus buffing the edges smooth.

9 Claims, 5 Drawing Sheets

BELT EDGE BURNISHING MACHINE

FIELD OF THE INVENTION

The present invention relates to belt edge burnishing machines. More particularly, the present invention relates to belt edge burnishing machines which simultaneously smooth the edges of a plurality of leather belts.

BACKGROUND INFORMATION

Leather belts are typically made by cutting an appropriately sized piece of leather into a desired belt shape and length from a larger piece of leather, punching holes in the belt, and sometimes adding a buckle having an arm which extends through a hole in the belt. Depending on the grade and natural coloring of the leather used to form the belt, it may also be necessary to paint or die the belt edges to provide an appealing color.

The cutting process used to cut individual belts from larger pieces of leather typically leaves rough edges. Thus, the rough belt edges are generally burnished or smoothed to eliminate the roughness left by the cutting.

Burnishing can be accomplished by rubbing or buffing the rough edges of the belt in a certain direction. The rubbing or buffing operation forces the leather fibers to run in the direction of the rubbing or buffing operation, thus smoothing the edge. Wax may also be applied to the belt edges to further smooth the roughness and finish the edge.

Different grades and styles of leather have different leather fiber characteristics and thus require different degrees of burnishing. Thus, it may desirable to perform an initial rough buffing operation to remove larger chips or deformities in the belt edge, followed by a polishing operation to further smooth the belt edge.

Prior art machines for treating leather belts typically are configured to work on only one belt at a time. For example, U.S. Pat. No. 1,734,365 issued to Collins discloses a machine for treating belts comprising a frame having a base and a table supported above the base which also supports a conveyor chain. The conveyor chain is mounted among sprocket wheels which in turn are mounted on shafts journaled in upright members. The device for receiving and starting a belt in the machine comprises a pair of plates spaced from each other a sufficient distance to allow a belt to pass therebetween. The belt is passed through a pair of burnishing wheels which are driven at a much higher rate of speed than the passing belt, thereby giving a polish to the edges of the belt. The machine also provides an operation for dying or coloring the edges of the belt. However, only one belt at a time can be fed through this machine.

U.S. Pat. No. 1,935,827 issued to Zwanzig discloses a machine for performing finishing operations on the edges or margins of a belt. Belts are introduced into this machine between rotating cutters arranged on spindles and driven by electric motors. The cutters operate on the hair side of the belt and braiding discs operate on the innerside of the belt to remove chips and dust from the belt. The belt is then colored or dyed and the belts are dried either by electricity or by using heated gas. Finally, the belt enters between slides which carry waxing felt blocks and polishing blocks. In this manner, the belt edges are waxed and ejected from the machine. This machine also is configured to accommodate only one belt at a time.

U.S. Pat. No. 2,664,732 issued to Tuck discloses a machine for automatically producing belts which bevels or trims the edges of the belt, punches holes in the belt to provide buckle reception slots and suitably spaced buckle tongue engagable holes in the belt, embosses or scores the face of the belt, and stamps the belt with size and suitable descriptive or other indicia. The machine comprises a plurality of work treating stations and a table for moving the belt from workstation to workstation, comprising a plurality of spaced guide structures mounted on and above the work supporting table and extending across the table. This machine is configured to operate on one belt at a time.

While the above-mentioned devices may work for their intended purposes, none of these devices are capable of burnishing a plurality of belts simultaneously to speed up the belt production process. Extended production time means additional cost of manufacture, which typically increases cost to the consumer. It is thus apparent that there is a need for an improved belt edge burnishing machine which can work on a plurality of belts simultaneously.

An object of the present invention is to provide a belt edge burnishing machine which can work on a plurality of belts simultaneously.

SUMMARY OF THE INVENTION

These needs and other needs are satisfied by the belt edge burnishing machine of the present invention. The belt edge burnishing machine of the present invention is configured to operate on a plurality of belts simultaneously. Thus, the burnishing operation for a number of belts can be completed in a fraction of the time it would take a prior art device to complete the operation.

The belt edge burnishing machine of the present invention comprises a conveyor and a buffing wheel. An electric motor is included for rotating the buffing wheel about an axis situated substantially parallel to the ground. The conveyor is configured to covey a plurality of belts through the burnishing machine.

The buffing wheel is located in a buffing wheel area in the burnishing machine and is positioned above the conveyor so that as the belts are conveyed through the buffing wheel area on the conveyor, the buffing wheel contacts the unfinished edges of the belts.

In one embodiment of the burnishing machine, two buffing wheels are used. The first buffing wheel, which is the wheel closest to the input side of the burnishing machine, can be made of an abrasive material while the second buffing wheel, which is the wheel farthest from the input side, can be non-abrasive. In this manner, the first buffing wheel rough finishes the belt edge by removing chips and nicks in the belt edge, while the second buffing wheel polishes the rough finished edge.

In a preferred embodiment, the conveyor comprises an edge finishing board, a plurality of rollers, and a pair of pusher bars. The edge finishing board is configured to hold the plurality of belts with an unfinished edge of the belt exposed. The pusher bars are connected to a chain drive which is driven by an electric motor. The electric motor has a speed adjustment so that the speed at which the belts are moved through the buffing wheel area can be adjusted to accomplish the desired finish.

In operation, the belts are placed on an edge finishing board with an unfinished edge of each belt facing upward. Prior to running the belts through the burnishing machine, the belt edges are painted, typically by hand. Painting the belt edges prior to burnishing them helps to stiffen and flatten the fibers so that they are more easily knocked off during the burnishing operation.

After painting the belt edges, the edge finishing board is placed on the rollers in the burnishing machine. The rollers comprise a conveyor table and the pusher bars are driven around the conveyor table by the motor driven chain drive. A pusher bar engages an edge finishing board moving the edge finishing board through the burnishings machine along the conveyor table. As the edge finishing board passes beneath the buffing wheels, the first buffing wheel and then the second buffing wheel contacts the belts held in the finishing board, thus burnishing the exposed unfinished belt edges. In embodiments having an abrasive buffing wheel, it may be necessary to repaint the belt edges after burnishing.

DETAILED DESCRIPTION OF THE PREFERRED EMBODIMENT

Figure 1:
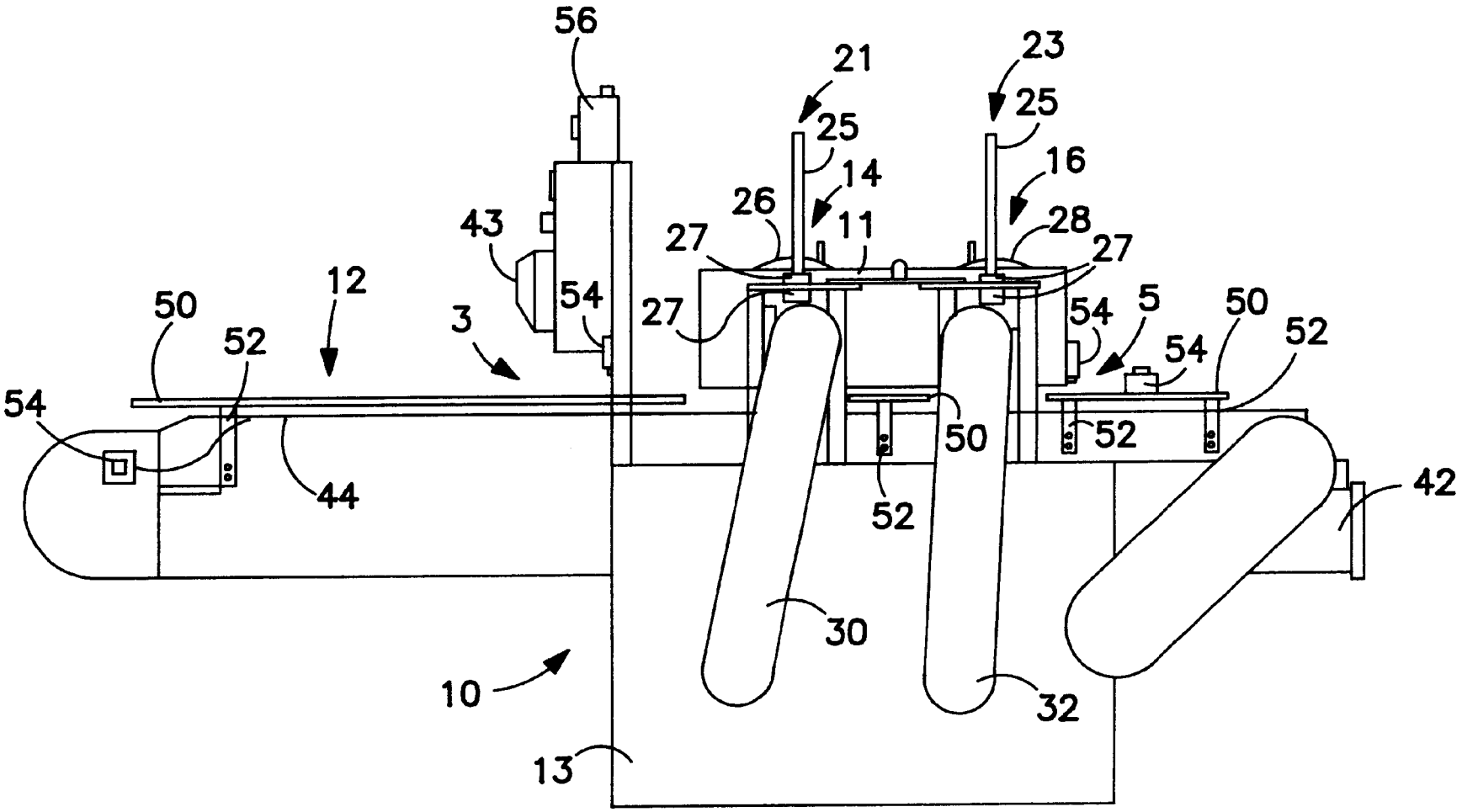
FIG. 1 is an elevational view of a belt edge burnishing machine according to the present invention.

In accordance with the present invention, a belt edge burnishing machine is described that provides distinct advantages when compared to those of the prior art. The invention can best be understood with reference to the accompanying drawing figures.

Referring now to the FIGS. 1–7, a belt edge burnishing machine, referred to generally by 10, comprises a conveyor 12 and a pair of buffing wheels 14 and 16. The conveyor 12 and buffing wheels 14 and 16 are supported by a support table 13.

The buffing wheels 14 and 16 comprise an elongated wheel-shaped buffing material having an elongated central axle 17. The buffing wheels 14 and 16 are housed in a buffing wheel housing 11 which is supported above the support table 13 and conveyor 12. The buffing wheel housing 11 includes a pair of buffing wheel access doors 26 and 28 (FIG. 2) for facilitating access to the buffing wheels 14 and 16, respectively.

A pair of buffing wheel height adjustment devices 21 and 23 secure the buffing wheels 14 and 16 to the burnishing machine 10 above the conveyor 12. In the preferred embodiment, the buffing wheel adjustment devices 21 and 23 comprise elongated threaded rods 25 and complimentary threaded nuts 27. Each rod 25 is connected to a buffing wheel axle 17. The rods 25 run through apertures in the buffing wheel housing 11 and are secured in place by the nuts 27. The buffing wheel adjustment devices 21 and 23 are adjustable so that the space between the conveyor 12 and buffing wheels 14 and 16 can be adjusted.

Electric motors 18 and 20 are included for rotating the buffing wheels 14 and 16, both in the same direction, about two axis situated substantially parallel to the ground and to the conveyor 12. In the preferred embodiment, the electric motors 18 and 20 comprise 5 h.p., three-phase electric motors. Drive belts 57 connect the electric motors 18 and 20 to the buffing wheel axles 17 and are used to drive the buffing wheels 14 and 16. A pair of motor housings 30 and 32 are included for housing the electric motors 18 and 20 and drive belts 57.

The conveyor 12 is configured to covey a plurality of belts 22 through the burnishing machine 10. The buffing wheels 14 and 16 are positioned above the conveyor 12 so that as the belts 22 are conveyed through the burnishing machine 10, the buffing wheels 14 and 16 contact an unfinished edge of the belts. The buffing wheels 14 and 16 are positioned one behind the other along the belt pathway so that they operate sequentially on the belts 22. The width of each buffing wheel 14 and 16 is at least equal to width of the edge finishing board 34 or the combined widths of the belt edges so that each buffing wheel 14 and 16 burnishes all the belts in the edge finishing board 34 simultaneously. In the preferred embodiment, the buffing wheels 14 and 16 are approximately 30" wide.

Preferably, the first buffing wheel 14, which is the wheel closest to the input end 3 of the burnishing machine 10, is made of an abrasive material while the second buffing wheel 16, which is the wheel closest to the output end 5, is non-abrasive. In this manner, the first buffing wheel 14 rough finishes the belt edge by removing chips and nicks in the belt edge, while the second buffing wheel 16 polishes the rough finished edge. In the preferred embodiment, the first buffing wheel 14 is made of fine abrasive Scotchbrite® material manufactured by 3M Corporation and the second buffing wheel 16 is made of a relatively non-abrasive canvas material.

Figure 2:
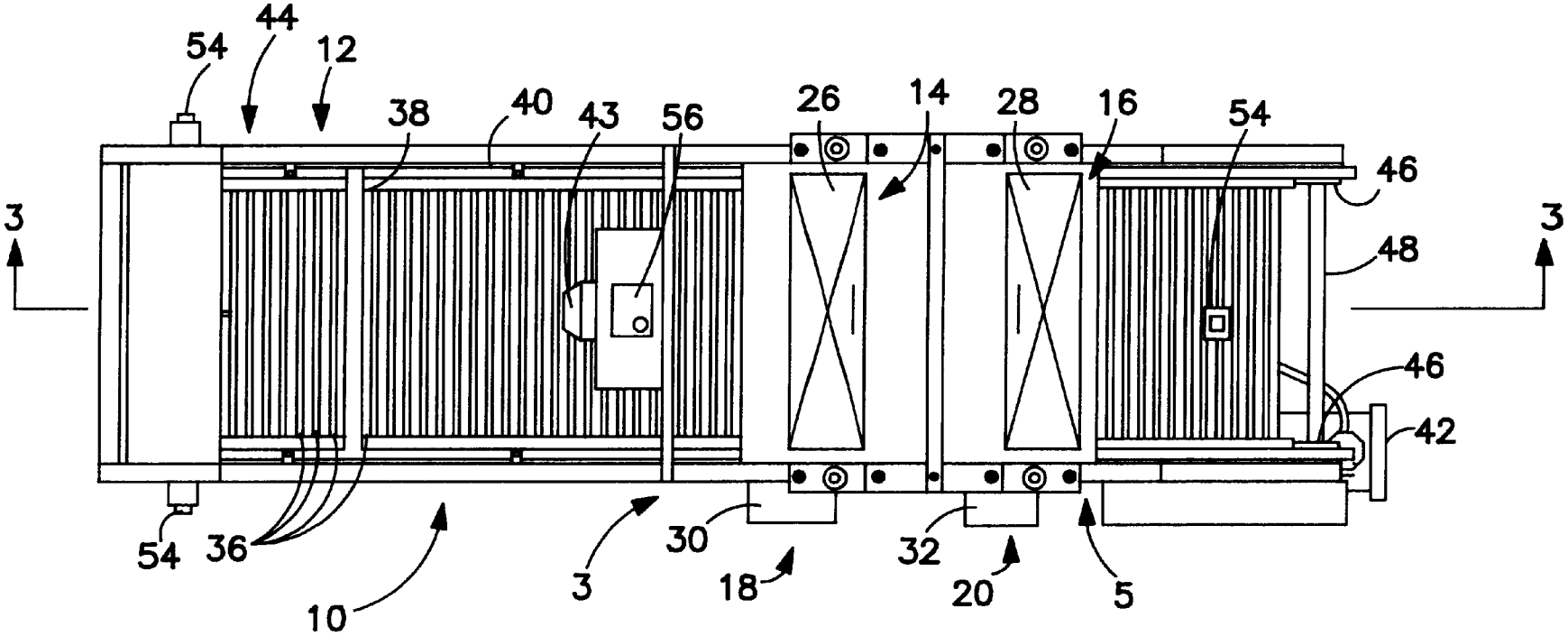
FIG. 2 is a top plan view of the burnishing machine of FIG. 1.
Figure 6:
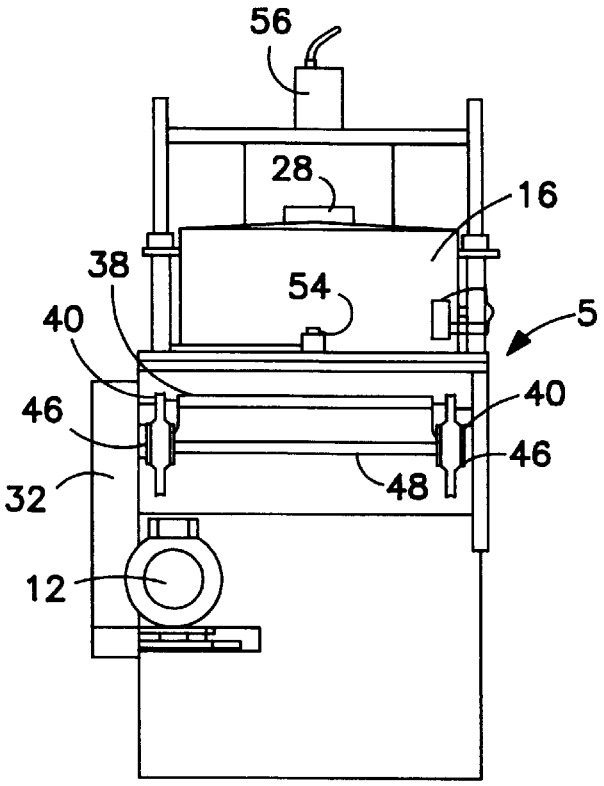
FIG. 6 is a rear elevational view of the burnishing machine of FIG. 1.
Figure 7:
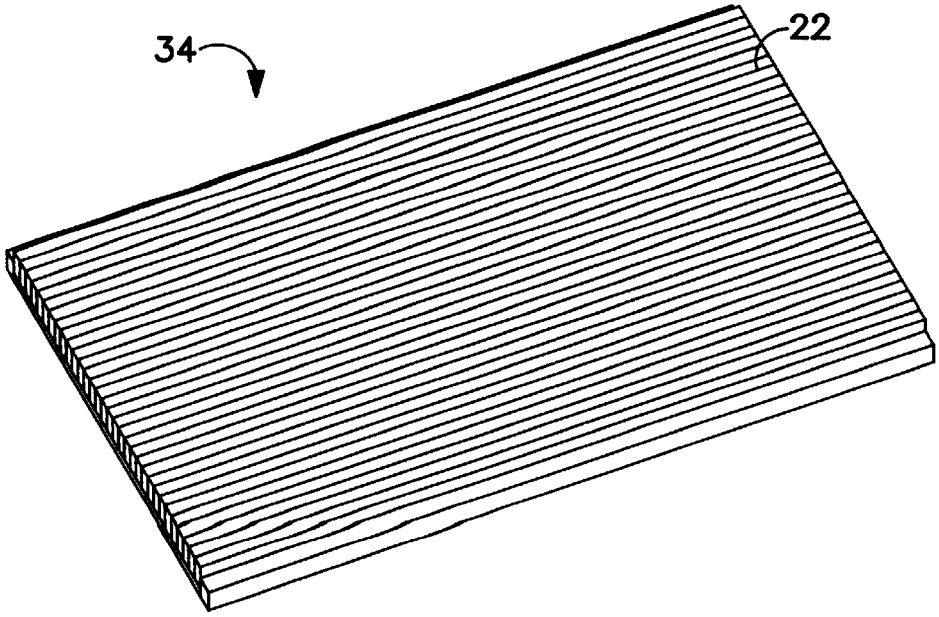
FIG. 7 is a top perspective view of an edge finish board according to the present invention.

Preferably, and as best seen in FIGS. 2, 6 and 7 the conveyor 12 comprises an edge finishing board 34, a plurality of rollers 36, and a pair of pusher bars 38. The edge finishing board 34 is configured to hold the plurality of belts 22 with unfinished edges of each belt exposed and upright, so that the large flat surface of each belt is perpendicular to the board. The edge finishing board 34 of the preferred embodiment holds between 140 and 150 belts simultaneously.

Figure 3:
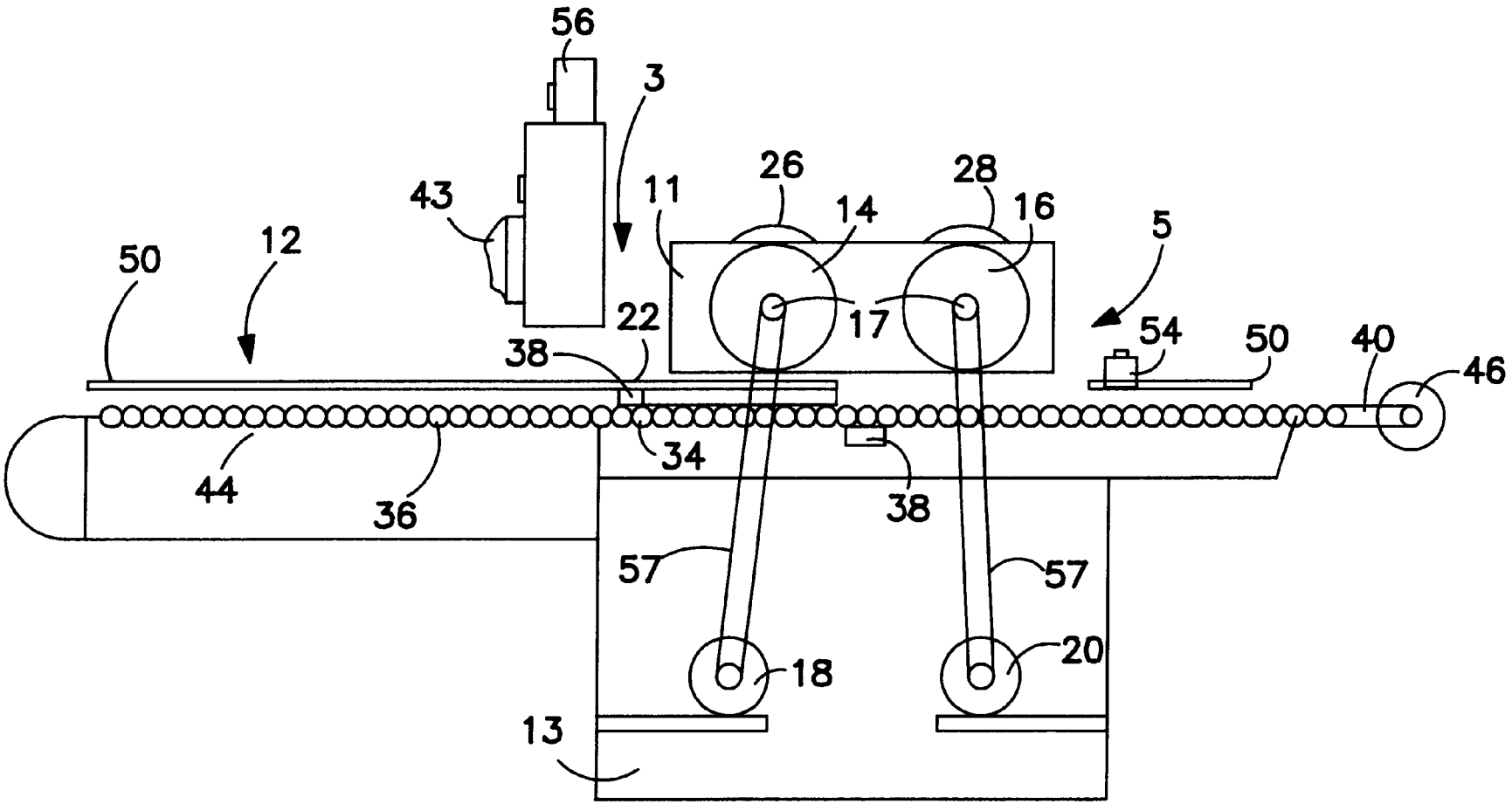
FIG. 3 is a sectional view of the burnishing machine of FIG. 2 taken along line 3—3.
Figure 4:
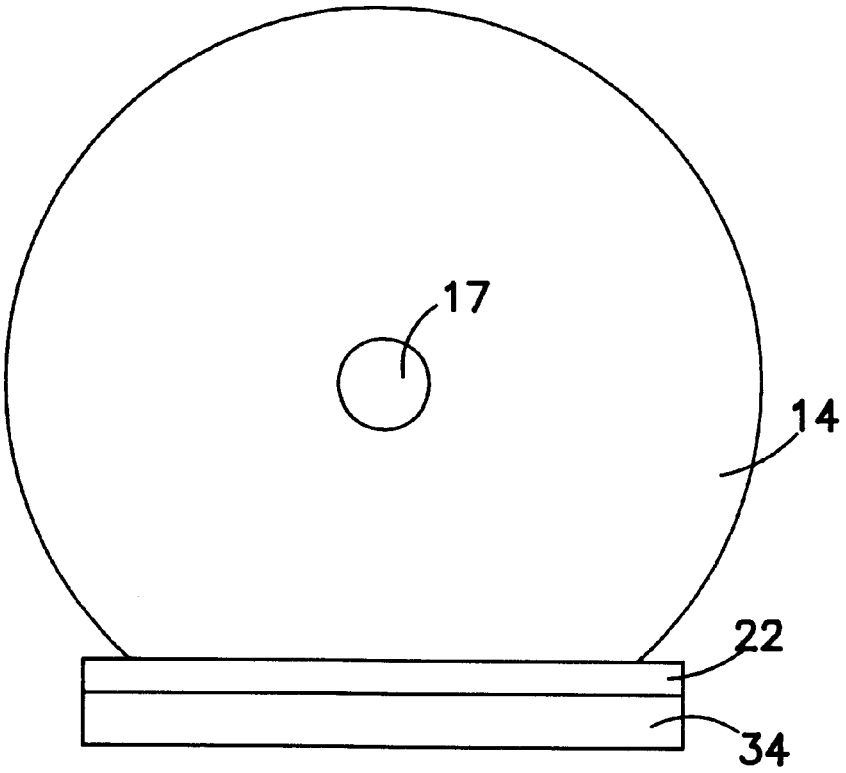
FIG. 4 is an enlarged side view of the first buffing wheel and edge finish board of FIG. 3.
Figure 5:
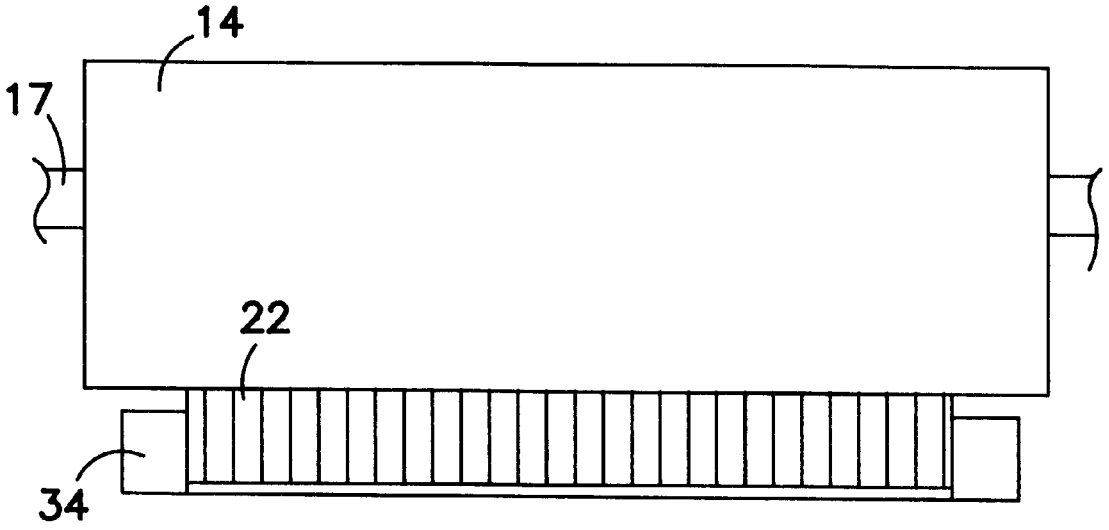
FIG. 5 is an enlarged front view of the first buffing wheel and edge finish board of FIG. 4.

The pusher bars 38 are positioned transversely to the longitudinal direction of the conveyor 12 and just above its surface so as to be able to contact an edge of the edge finishing board 34. The pusher bars 38 are connected to a chain drive 40 which is driven by an electric motor 42. In the preferred embodiment, the electric motor 42 comprises a ½ h.p., 170 volt, D.C. gear motor. As shown in FIG. 3, the pusher bars 38 are located approximately 180° apart on the drive chain 40 so that when one pusher bar 38 is positioned above the rollers 36 the other is positioned below the roller 36. As the pusher bars 38 are driven by the chain drive 40, the pusher bars 38 move the edge finishing board 34 along the conveyor 12. The electric motor 42 has a speed adjustment 43 so that the speed at which the belts 22 are moved through the burnishing machine can be adjusted to accomplish the desired finish.

The rollers 36 are arranged substantially horizontal to form a conveyor table 44. The rollers 36 are transverse to the longitudinal direction of the conveyor 12 and define a belt pathway from the input end 3 to the output end 5 along which the belts 22 can move. The chain drive 40 and pusher bars 38 are configured to circle the conveyor table 44. A pair of gears 46 connected together by an axle 48 are positioned at each end of the conveyor table 44 and are configured to rotate the chain drive 40. The chain drive motor 42 is connected to the gears 46 and axle 48 in a conventional manner to drive the chain drive 40.

Plexiglass conveyor shields 50 are positioned above the conveyor 12 outside the buffing wheel area to protect the burnishing machine operator, as best shown in FIG. 1. The conveyor shields 50 are connected to the conveyor table 44 by connection tabs 52. In a preferred embodiment, emergency stops are wired into the shields 50 so that if a shield 50 is removed from the machine 10, all moving parts of the machine are shut down.

Emergency stop switches 54 are positioned at each end of the burnishing machine 10 and all moving parts. The emergency stop switches 54 shut down the conveyor 12 in cases of emergency. A main disconnect 56 is also provided for cutting power to the entire burnishing machine.

In operation, an edge finish board 34 is loaded with a plurality of belts 22 with an unfinished edge of each belt facing upward. The unfinished edge of each belt is painted, typically by hand, and the loaded edge finishing board 34 is placed on the conveyor table 44 at the input end 3. A pusher bar 38 engages the edge finishing board 34, moving the edge finishing board 34 through the burnishing machine 10 along the conveyor table 44. As the edge finishing board 34 passes beneath the rotating buffing wheels 14 and 16, the buffing wheels 14 and 16 contact the belts 22 held in the finishing board 34 and burnish the exposed unfinished belt edges. The pusher bar 38 forces the finishing board 34 out the output end 5 of the burnishing machine 10 and onto a work table (not shown) situated adjacent to the conveyor table 44. The burnishing machine operator then flips the belts 22 over, thus reloading the edge finishing board 34 with the opposite unfinished belt edges exposed, and runs the reloaded edge finishing board 34 through the burnishing machine 10 again.

It will be apparent to those skilled in the art that modifications may be made without departing from the spirit and scope of the invention, Accordingly, it is not intended that the invention be limited except as may be necessary in view of the appended claims.

What is claimed is:

1. A belt edge burnishing machine for simultaneously burnishing the edges of a plurality of belts, the belt edge burnishing machine having an input end and an output end and comprising:

conveyor means for simultaneously conveying the plurality of belts from the input end to the output end of the burnishing machine with said plurality of belts being positioned adjacent to each other lengthwise with an unfinished edge of each of said plurality of belts exposed;

at least one buffing wheel spaced apart from said conveyor means and at least equal in width to the combined widths of the belt edges on the conveyor means; and means for rotating said buffing wheel about an axis, wherein said rotating buffing wheel contacts and burnishes said unfinished edge of each of said plurality of belts simultaneously.

2. The burnishing machine of claim 1 wherein said conveyor means defines at least one generally planar surface and said axis is substantially parallel to said planar surface.

3. A belt edge burnishing machine for simultaneously burnishing the edges of a plurality of belts, the belt edge burnishing machine having an input end and an output end and comprising:

conveyor means for conveying the plurality of belts from the input end to the output end of the burnishing machine with an unfinished edge of each of said plurality of belts exposed;

at least one buffing wheel spaced apart from said conveyor means and at least equal in width to the combined widths of the belt edges on the conveyor means; and means for rotating said buffing wheel about an axis, wherein said rotating buffing wheel contacts and burnishes said unfinished edge of each of said plurality of belts simultaneously wherein said conveyor means comprises an edge finish board for holding said plurality of belts and moving means for moving said edge finishing board from the input end to the output end.

4. The burnishing machine of claim 3 wherein said conveyor means further comprises a plurality of rollers in substantially horizontal arrangement and transverse to a longitudinal dimension of said conveyor means, said rollers defining a belt pathway, extending from the input end to the output end of the burnishing machine.

5. The burnishing machine of claim 4 wherein said conveyor means further comprises a pusher bar parallel to said rollers and drive means for moving said pusher bar along said belt pathway, wherein said pusher bar is configured to engage and move said edge finish board along said belt pathway.

6. The burnishing machine of claim 5 wherein said drive means comprises a chain operably connected to said pusher bar and an electric motor to drive said chain.

7. The burnishing machine of claim 6 wherein said electric motor further comprises speed adjustment means for adjusting the speed at which said plurality of belts move along said belt pathway.

8. The burnishing machine of claim 1 wherein said buffing wheel is made of a canvas material.

9. The burnishing machine of claim 1 further comprising a second buffing wheel, said at least one buffing wheel being positioned closer to said input end than said second buffing wheel and wherein said at least one buffing wheel is more abrasive than said second buffing wheel.

* * * * *